US007758446B2

(12) United States Patent
Hodgetts

(10) Patent No.: US 7,758,446 B2
(45) Date of Patent: Jul. 20, 2010

(54) GOLF CLUB SHAFT TUNER

(76) Inventor: George W Hodgetts, 18 Meadow Ave., Westerly, RI (US) 02891

( * ) Notice: Subject to any disclaimer, the term of this patent is extended or adjusted under 35 U.S.C. 154(b) by 0 days.

(21) Appl. No.: 12/214,003

(22) Filed: Jun. 16, 2008

(65) Prior Publication Data

US 2009/0005189 A1 Jan. 1, 2009

Related U.S. Application Data

(63) Continuation-in-part of application No. 10/366,854, filed on Feb. 14, 2003, now abandoned, and a continuation-in-part of application No. 10/915,512, filed on Aug. 9, 2004, now abandoned.

(51) Int. Cl.
*A63B 53/00* (2006.01)

(52) U.S. Cl. ..... 473/289

(58) Field of Classification Search ..... 473/289
See application file for complete search history.

(56) References Cited

U.S. PATENT DOCUMENTS

| | | | | |
|---|---|---|---|---|
| 3,833,223 | A * | 9/1974 | Shulkin | 473/238 |
| 5,004,236 | A | 4/1991 | Kameshima | |
| 5,054,781 | A | 10/1991 | Soong | |
| 5,083,780 | A | 1/1992 | Walton et al. | |
| 5,478,075 | A | 12/1995 | Saia et al. | |
| 5,632,691 | A | 5/1997 | Hannon | |
| 5,716,289 | A | 2/1998 | Okoneski | |
| 6,045,457 | A | 4/2000 | Soong | |
| 6,056,646 | A | 5/2000 | Soong | |
| 6,113,508 | A | 9/2000 | Locarno et al. | |
| 6,183,375 | B1 | 2/2001 | Weiss | |
| 6,241,623 | B1 | 6/2001 | Laibangyang | |
| 6,361,451 | B1 | 3/2002 | Masters et al. | |
| 6,394,909 | B1 | 5/2002 | Laibangyang | |
| 6,494,109 | B2 | 12/2002 | Weiss | |
| 7,024,953 | B1 | 4/2006 | Weiss | |
| 7,479,069 | B2 * | 1/2009 | Cheng et al. | 473/318 |
| 2001/0005696 | A1 | 6/2001 | Hendrick | |
| 2008/0153620 | A1 * | 6/2008 | Hueber | 473/289 |
| 2009/0005189 | A1 * | 1/2009 | Hodgetts | 473/289 |

FOREIGN PATENT DOCUMENTS

| | | | |
|---|---|---|---|
| GB | 2040693 | A * | 9/1980 |
| JP | 05192424 | A * | 8/1993 |
| JP | 11047326 | A * | 2/1999 |
| JP | 2000185119 | A * | 7/2000 |
| JP | 2002306643 | A * | 10/2002 |

* cited by examiner

*Primary Examiner*—Alvin A Hunter

(57) ABSTRACT

A moveable shaft insert assembly about 13 to 18 inches long weighing less than 50 grams is inserted into a hollow golf dub shaft wherein the depth of insertion of the shaft insert assembly may vary from about 1 to 10 inches. Changing the location of the shaft insert assembly allows a player to change the flex of the shaft and thereby optimize the performance of the club dynamics for that player for that day. The shaft insert is held in place by friction between the shaft and the shaft insert assembly. So shaft flex fitting can be administered by a player with or without coaching, and can be revisited at any time by a simple adjustment. The shaft inserts are useful on all hollow shaft clubs, and can be retrofitted to existing clubs without removing the grip.

2 Claims, 6 Drawing Sheets

INCREASE IN SHAFT FLEX

GOLF CLUB SHAFT TUNER

CROSS REFERENCE TO RELATED APPLICATION

This application is a continuation-in-part of U.S. patent application Ser. No. 10/366,854, filed Feb. 14, 2003 now abandoned and 10/915,512 filed Aug. 9, 2004 now abandoned.

BACKGROUND OF THE INVENTION

This invention relates to golf clubs and particularly to the continual adjustment of their shaft flex to match the dynamic characteristics of a player on a given day which we will refer to as tuning the shaft This is accomplished by the addition of a rigid tubular insert with a compressible outer surface which provides enough friction and compressibility to hold it in place when inserted within a golf club shaft so as provide a method of adjusting the overall shaft flex by changing its penetration within the shaft. The penetration can be changed at any time although the rules governing competitive golf forbid making such changes during a round It is the object of this invention to provide the means to tune the shaft of a dynamically swung golf club, but not a putter which require adjustments other than flex, to match a player's tempo over a range.

It is a further object of this invention to compensate for misalignment of the spine of a shaft or at least not to add to the detrimental effects of said misalignment.

Technical specifications commonly used to describe golf clubs include: total weight, swing weight, length, loft angle, lie angle, head size and weight, grip diameter, and shaft flex. But the proper selection of the latter is generally acknowledged to be most important when fitting clubs to a golfer. Moreover, recent studies have shown that it is very important for custom golf club fitters to find the optimum flex for each player for improved shot control and greater distance. But finding the optimum flex has perplexed most teachers, club fitters and golfers.

Three methods for finding the best flex before club assembly presently dominate the market for custom clubs. In the first fitting method, the player swings one dub several times and the average club head speed measured and a formula used to calculate the flex for the entire club set The second approach relies on matching one club or a set of clubs to a players favorite club. In the third method, a player hits several shots with each of many calibrated test clubs, finally selecting the best of the lot judged by one of several radar devices that measure several parameters. The best club then serves as a model for his entire set, which can be matched to it. But once the clubs are constructed after fitting by any method, only minor adjustments of swing weight are possible until another set is purchased, in many cases by the golfer's belief that a better fit is probable.

Many factors such as club head speed, swing time duration, and acceleration, effect the choice of optimum flex for each player. So while it is generally accepted that there is a best flex for every player, the best flex on one day will not be the best flex for all days, since weather temperature and muscle tone change over the seasons. This suggests that a method for altering the flex of a golf club after it is constructed, even if it was fitted accurately to the conditions on the fitting day, would be a tremendous benefit For example, many of the touring pros bring with more than one driver to tournaments, choosing the one that works best on the driving range the same day of each tournament round. One famous pro, preceding his US Open win, warmed up before the last round, and choose one driver to play with over his two others that were separated by only one seventh of a flex each. The present invention allows flex adjustments over an entire flex and would eliminate the need to carry multiple drivers.

More recently, several leading club manufacturers began offering drivers with two or three quick-connect shafts in an effort to find a better flex fit. While one shaft is bound to be better than another, they are nevertheless separated by a whole flex and would yield the best flex only by chance. This conclusion is supported by tests on hundreds of players and proved that at least twenty test clubs separated by one seventh of a flex, or 3 CPM, are required to cover the range of flexes that prove to be best for 95 percent of golfers. To cover the same range with quick-connect shafts, the manufacturers would need to provide same number of shafts, or 20 shafts, instead of only three, each separated by only one seventh of a flex or 3 CPM. The cost of this approach would be prohibitive. But here comes this invention to help bridge the fine adjustments of flexes between the coarser steps allowed by only a few quick-connect shafts, which would need to be separated by only one whole flex, at a much lower overall cost.

To understand why adjusting the shaft flex of a golf club is critical for good play, one must understand the role of the shaft which is to deliver the club head to the ball at the best attitude and phase angle of the various oscillations occurring in the Swing Plane, Toe Plane and Torque Axis. For the ball to be struck solidly, the sum of these angles must compensate for the errors in that player's swing path and timing.

For maximum energy transfer and therefore the longest shots, the center of gravity of the club head should strike the ball. But for straighter shots for a golfer with an average swing, it may be better for ball contact to occur slightly off-center to compensate for player-induced errors in the swing plane or torque deflection errors caused by club head and shaft characteristics. Although hard to fix in practice, player-induced errors are easy to identify using photography. Errors in directional control due to shaft oscillation phase angle are much more difficult to measure. Shaft flex oscillation in the Swing, Toe and Torque Planes are measured during player swings using strain gauges mechanically attached to the shaft and electrically connected to a computer, and the waveforms recorded. During a typical swing of slightly over one second duration, the shaft bends around 3 inches in all directions through 1.25 cycles of its flex frequency, in both the Swing and Toe Plane, both axes having the same flex frequency. The Torque Plane features an oscillation that is independent of the other two flex frequencies and is three to four times higher, 3.75 to 5 cycles, depending on the shaft model, with amplitude of a few degrees of angle. All three axes can have different phase angles at ball contact, varying from swing to swing for the same player, and varying more from player to player. The Toe Plane phase angle predominantly determines where on the club head the ball is struck, and the Swing Plane and Torque Plane phase angles determine the aiming direction of the club head at contact.

For example, if the club head is slightly open at ball contact due to player-induced Swing Plane error and Torque oscillation combined, which would cause the ball to go to the right of the target, then striking the ball off-center near the toe of the club face is best, since that will bring the ball back toward the target line. This is known as the gear effect due to right-to-left spin imparted from such contact, the latter of which being well known in the art. The net result of all these errors, without identifying the extent of any of them, is that some errors will cancel each other and cannot be predicted in their net effect, which is required to build optimized clubs with fixed parameters. The best compromise of each player's swing idiosyncrasies and club design parameters can only be found by adjusting the flex after club manufacture in order to adjust shaft deflection incrementally in the Toe Plane. This has the effect of determining where the ball strikes the club head, which the inventor believes allows fine tuning of directional control for most players. This concept runs counter to almost all that is written and most likely believed by experts who teach golf and design golf equipment, but is the crux of this invention. Most preferably, the adjustment of the flex of a club is performed after the club has been assembled as this technique provides an opportunity to compensate for all the variables in a practical manner

PRIOR ART

Heretofore, there have been competing attempts to modify the flexural characteristics of golf shafts after club assembly by adding either fixed or adjustable materials to either the outer or the inner surface of the shaft. Almost all of these attempts which add material to the outer surface of the shaft are accompanied by adverse cosmetic results. Those which attempt to change the shaft frequency from inside the shaft have been too heavy, too expensive, or are fixed in place after insertion and allow for no further adjustments during practice or play. Thus there remains a need for a system which will allow for continual flex adjustments over a large range in small steps.

A number of patents have alleged to adjust golf dub shaft flex or place objects inside the shaft to accomplish other missions and the most important ones are listed below.

U.S. Pat. No. 6,113,508 of M. Locarno et al (Sep. 5, 2000) employs an internal eccentric stiffening rod having a different stiffness depending on the angles of attachment. Because the patent deliberately causes the shaft flex to be radially unequal in shape as well as in flex, clubs produced by this method violate the USGA rules.

Another method for modifying flex entails adding a stiffening rod to the inside of a shaft, e.g. U.S. Pat. No. 3,833,233 of R. Shullin (Sep. 3, 1974). Varying lengths of shaft elements are inserted into dubs used specifically for fitting flex to a player. The inserted shaft elements are not to be adjusted in their position once in place, but only exchanged and are not intended to be present in a set of clubs during play. Rather, the elements are only to be used for fitting.

In U.S. Pat. Appln, No. US 2001/0005696 of M. Hendrick (Jun. 28, 2001), a short, generally 1-3 inch long, hollow shaft insert is used to change the swing weight of a club. It can be readjusted at any time, but does not, of itself, have any impact on the swing characteristics of the club other than swing weight. The patent specifically excludes changing the shaft flex using this design and inserts less than 11 inches long have little or no effect on flex as shown in FIG. 6.

U.S. Pat. No. 5,478,075 of C.R. Saia et al (Dec. 26, 1995) describes a method of changing shaft flex using an insert with radially expandable rubber discs that can be expanded by turning a threaded energizing rod. The rubber discs are stationary as they expand and do not move in or out of the outer shaft.

U.S. Pat. No. 6,361,451 of B. Masters et al (Mar. 26, 2002), U.S. Pat. No. 6,241,623 to C. Liabangyang (Jun. 5, 2001), and U.S. Pat. No. 6,394,909 to C. Laibangyang (May 28, 2002) utilize a wire strung down the center of a golf shaft the tension of which is adjustable to exert varying compressive forces on the shaft thereby seeking to change its flex. The three inventions allow players to adjust flex in order to deliver more energy stored in the flex at ball impact, a near impossibility in practice, as mentioned earlier.

Another attempt to change the overall flex and also dampen the shock effect of a ball strike from the club head to the hands is referred to in U.S. Pat. No. 5,083,780 of T. C. Walton et al (Jan. 28, 1992). In this patent, the grip end is reinforced by a cylinder placed between the grip and the shaft under the grip thereby lowering the flex point, increasing the flex and dampening vibrations from the club head to the hands. Once set, it is not adjustable in practice or play.

U.S. Pat. No. 6,045,457 of T. Soong (Apr. 4, 2000) discloses a method of inserting a second shaft inside a bulged outer shaft to increase the flex of the resultant shaft combination. The patent claims that the resultant fixed amount of increase in flex and lowering of the flex point increases dub head speed. The bulged outer shaft serves to ensure that the second shaft only contact the main shaft at the two ends of the second shaft, i.e. the middle section of the second shaft does not contact the main shaft The force exerted by the second shaft is due only to rigidity of the insert because the insert is anchored at its butt end at the grip and only touches the outer shaft at the opposite end. Our tests show that an inner shaft must contact present invention provides such contact.

U.S. Pat. No. 5,054,781 of T. Soong (Oct. 8, 1991) discloses a method of building a shaft with a fold back shaft that is inserted and contacts the inner wall of the outer shaft only after some degree of shaft bending. The claim of increased energy storage and release at ball contact is dubious, and while it employs an insert to change the flex of the shaft, once set, it is not adjustable as the present invention provides.

U.S. Pat. No. 6,056,646 of T. Soong (May 2, 2000) employs a fixed insert to stiffen the flex of the outer golf shaft but is non-adjustable once installed. It is intended to stiffen the flex only when the shaft is flexed beyond a certain point The flex is increased when the tip of the insert is in contact with the outer shaft which occurs only when the shaft is extremely bent unlike the present invention which exerts pressure throughout the range of bending of the shaft.

U.S. Pat. No. 5,004,236 of Makoto Kameshima (Apr. 2, 1991) employs tubular elements inserted at various points to stiffen a golf club shaft, but all must be permanently fixed in place at the kick points once the optimum flex is determined and cannot be adjusted thereafter. The length of the elements is not defined but the one shown under the grip does not extend beyond the length of the grip. Since the standard grip length is 10.5 inches, the insert is below the minimum of 11 inches needed to affect the flex of the shaft as shown in FIG. 6.

U.S. Pat. No. 5,632,691 of Richard Hannon (May 27, 1997) teaches adding a weight of 100 to 570 grams to a putter shaft to change the balance point. Not only does he specifically warn away from using these weights in shafts of other clubs in the set that are swung dynamically, but anyone skilled in the art would never add weights of this magnitude knowing full well that swing speed would be reduced considerably as shown in FIG. 8. Adding more than 50 grams to a club other than a putter would defeat the good work of the shaft manufacturers over the last 30 years wherein they have reduced the weight of shafts by employing graphite and other space age materials from over 100 grams to around 50 grams. This shaft weight reduction allowed 20 grams to be added to the heads for the same club swing weight Adding back 100 grams to the club at any position, under the grip, down the shaft or to the head is obviously impractical. Also, Hannon advocates employing material suitable for changing weight distribution only. These materials lack rigidity and would not stiffen the shaft of a putter or any other club as the present invention advocates.

U.S. Pat. No. 5,716,289 of Joseph Okoneski (Feb. 10, 1998) teaches the permanent attachment with an adhesive of an assembly of a receptacle and a weight under the grip eliminating further movement of the assembly. It adds weight but does not affect the flex of the golf dub shaft since none of the elements are longer that the grip which is less than 11 inches, the shortest insert found to have an appreciable effect on flex as shown in FIG. 7.

Many other patents feature shaft inserts that are primarily concerned with damping high frequency vibrations transmitted from the club head to the hands.

None of the prior art has succeeded in creating a practical golf club which allows a player to repeatedly adjust the flex and play with that club after it has been determined that the club performance is maximized nor to allow future adjustment of the flex as playing conditions change. It should be noted for those unfamiliar with recent USGA rules changes, that it is now permissible to play with an adjustable flex club shaft as long as no adjustments are made during a competitive round of golf wherein scores are reported.

Several patents by Richard M. Weiss, U.S. Pat. No. 6,183,375 (Feb. 6, 2001), 6,494,109 (Dec. 17, 2002), and 7,024,953 (Apr. 11, 2006) teach how to find the spine of a golf club shaft and to align it so that the pattern traced by the dub head, when clamped by its grip and oscillated in the swing plane which is the accepted spine alignment test, remains oscillating in the swing plane, as shown in FIG. 10, and does not gallop in the toe plane, as shown in FIG. 9. This invention makes no claim on orienting the spine before or after the shaft is installed, but teaches that adding an insert should not disrupt the test for proper spine alignment in the finished club. The pattern shown in FIG. 9 indicates a spine misalignment while the pattern shown in FIG. 10 signifies proper alignment. By rotating the insert circumferentially using the, the oscillations can be forced to conform in most cases, to the pattern of FIG. 10 and should be left in that orientation for all flex adjustments.

Accordingly, it is the object of this invention to provide a means which will enable a player to adjust the shaft flex of a golf club during practice and play in order to discover the best shaft flex for that player with minimal disruption of the weight distribution.

It is the further object of this invention to align the insert circumferentially with the shaft spine to avoid unwanted galloping when the club is oscillated by its grip in the accepted spine alignment test.

Still further objects and advantages will become apparent from a consideration of the ensuing description and accompanying drawings

DRAWINGS—BRIEF DESCRIPTION OF THE DRAWINGS

DRAWINGS—REFERENCE NUMERALS

| | | | | | |
|---|---|---|---|---|---|
| 10 | golf club shaft | 12 | grip | 19 | shaft insert assembly |
| 14 | club head | 16 | shaft insert | | |
| 17 | insert adjuster | 18 | compressible friction agent | | |

SUMMARY OF THE INVENTION

The object of the invention is to provide a means to adjust the flex of a dynamically swung golf club at any time after the club is assembled. This is achieved by placing a moveable rigid tubular shaft insert assembly in the hollow portion of the grip end of the golf club shaft whose penetration can be altered. The insert assembly comprises a shaft insert, which is a piece of rigid tubular material about 12 to 24 inches, preferably about 13 to 18 inches, coated with a compressible friction agent. To prepare the insert assembly, the insert is coated with a compressible agent that is self adhering to the insert and is allowed to cure before insertion of the assembly into the golf shaft. In this way, the agent adheres permanently to the insert and is held in place inside the shaft only by the friction caused by compression of its cured surface providing purchase to the inner surface of the golf shaft. The assembly has a smaller diameter than the golf club shaft into which it is inserted. The insert and can be tapered or cylindrical. By changing the depth of penetration of the shaft insert assembly between about 1 to 10 inches, the flex of a golf club can be adjusted to a particular player's swing dynamics to achieve better performance. The insert assembly is fixed in place by friction within the shaft and there is little to no likelihood of it working loose during a round of golf. However, it can be readjusted and thus the fitting of the club to the player can be revisited at any time. This invention can be used on any clubs with hollow shafts but has maximum benefit for the longer clubs, such as drivers and fairway woods and no effect on putters whose shafts bend very little, if at all.

DESCRIPTION OF THE PREFERRED EMBODIMENTS

Figure 1:
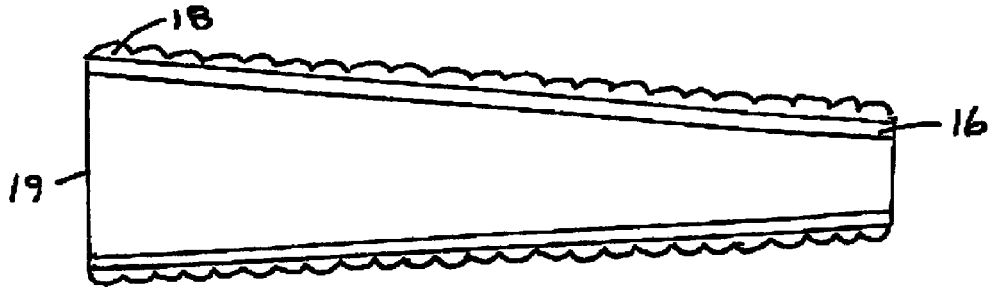
FIG. 1 is a plan view of the rigid tubular insert assembly 19

As shown in FIG. 1, the preferred embodiment of this invention is a tapered rigid tubular shaft assembly 19 comprising an insert 16, of 12 to 24 inches in length, coated with a compressible friction agent 18, such as silicone. Alternatively, the rigid tubular shaft may have internal female threads at one end allowing for extraction with an insert adjuster 17, as shown in FIG. 3. The insert assembly 19, comprised of insert 16 and friction agent 18, are inserted into a golf club shaft 10, as shown in FIG. 2, for the purpose of adjusting the stiffness of the golf club shaft.

Figure 2:
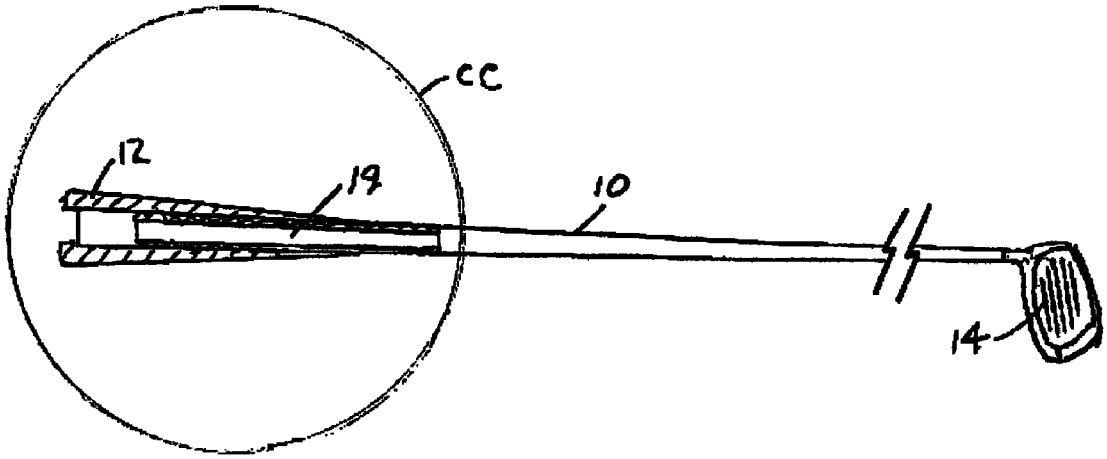
FIG. 2 is a plan view of a golf club with a shaft insert assembly in place
Figure 3:
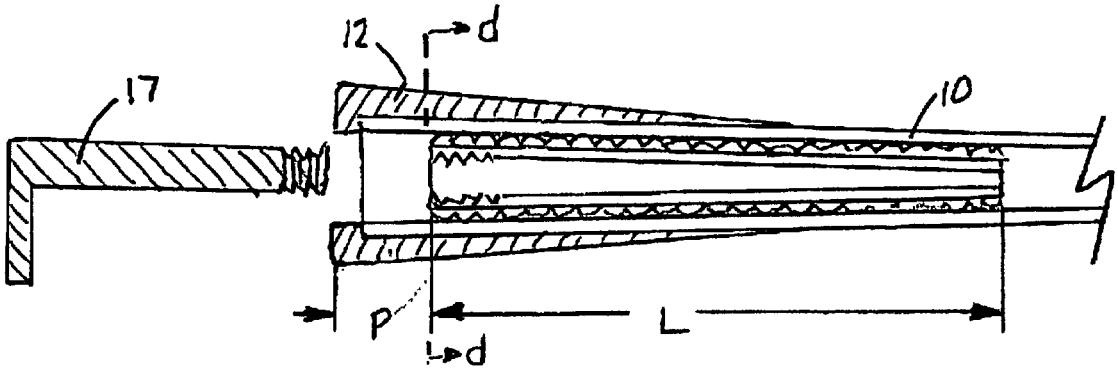
FIG. 3 is an expanded view of section cc in FIG. 2 with threaded extractor 17
Figure 4:
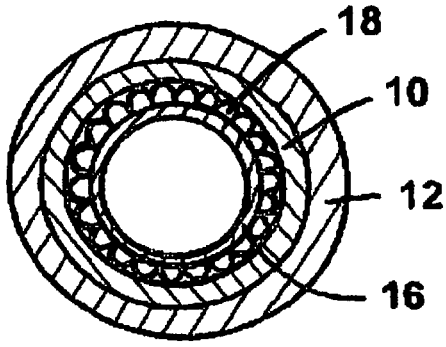
FIG. 4 is and end view of section dd in FIG. 3

As shown in FIG. 2, a conventional golf dub comprises a golf club shaft 10, usually about 34 to 47 inches in length, having a grip 12 at the butt end and a club head 14 at the tip end of said golf club shaft. A club head may be a "wood" head or an "iron" club head, both or which can be manufactured from a variety of materials including metals, wood, composites, graphite and poly-carbonate or combinations of materials. Shafts are constructed from a variety of materials, mostly steel, aluminum, graphite, or titanium. They are usually tapered but must be of homogeneous circular cross section and have equal stiffness in all orthogonal directions in order to conform to the current rules governing competition enforced by the U.S. Golf Association.

Figure 6:
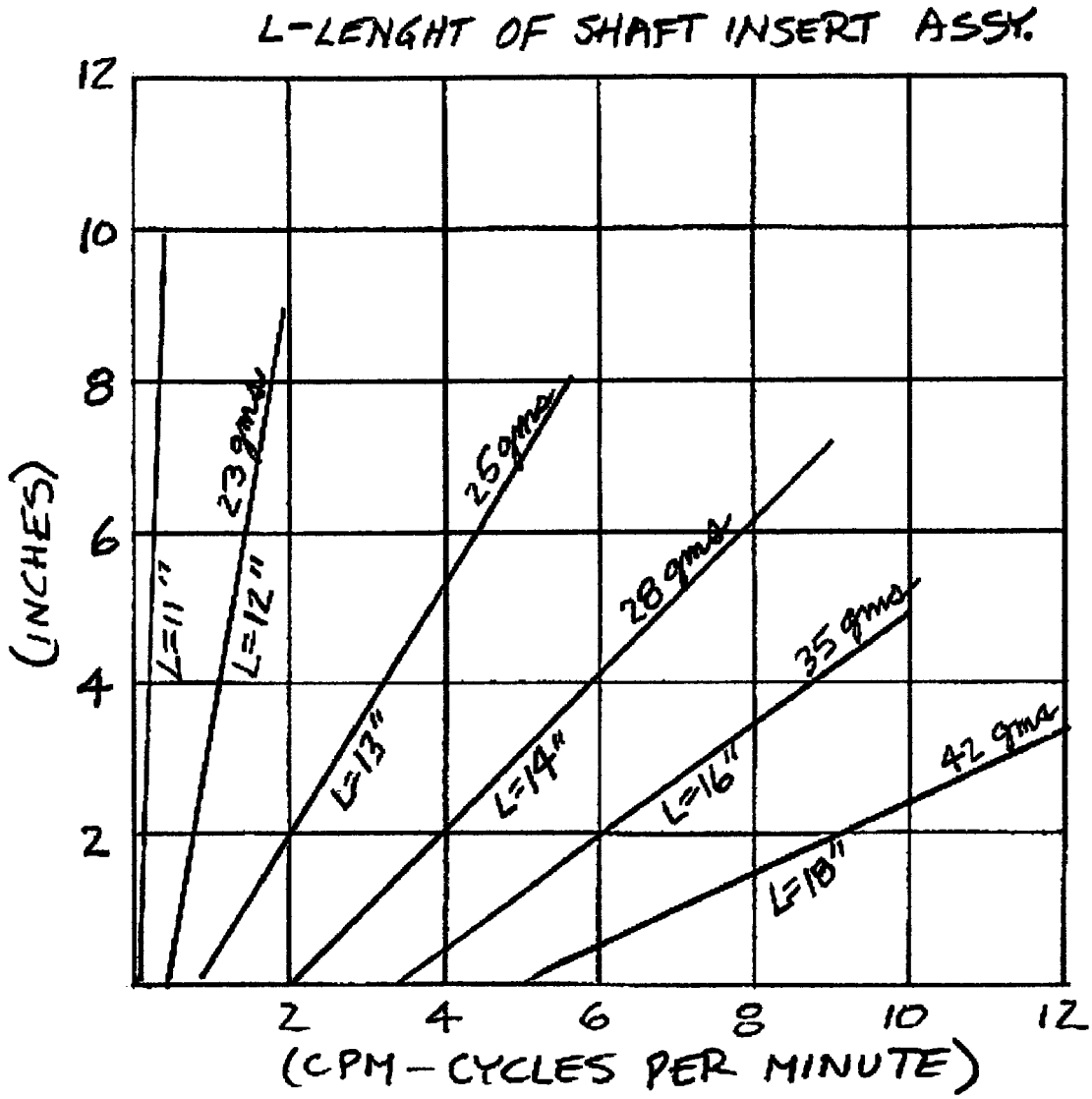
FIG. 6 is a graph of flex increase versus insert penetrations for various insert lengths
Figure 7:
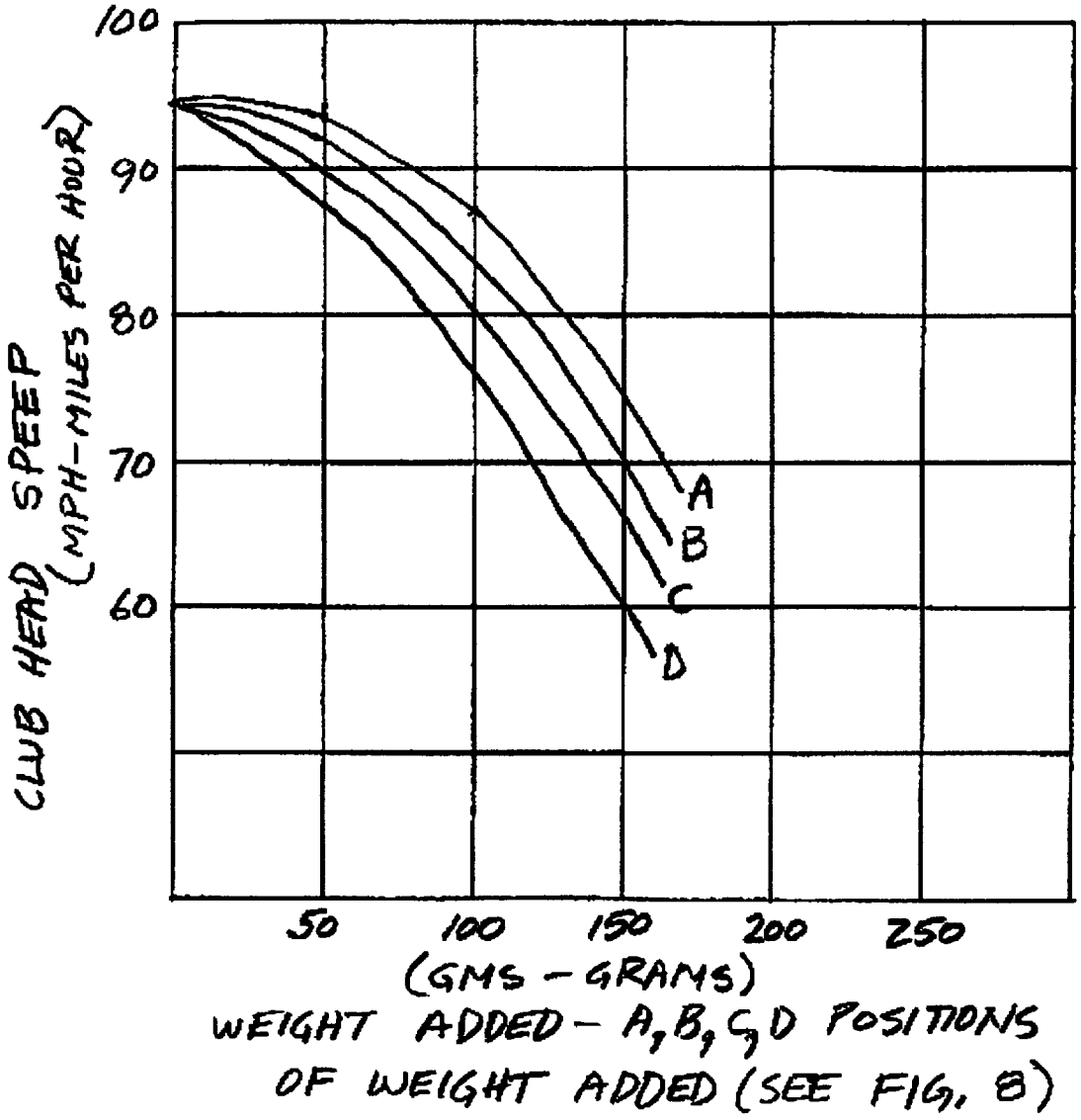
FIG. 7 is a graph of club head speed versus added weight for various weight positions
Figure 8:
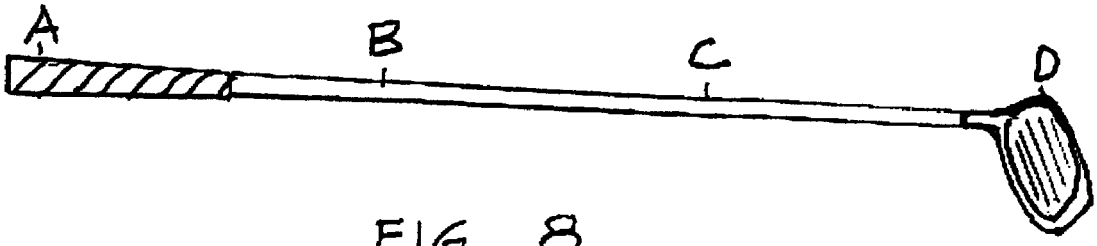
FIG. 8 is a plan view of a 45 inch driver showing positions of weights in FIG. 8
Figure 9:
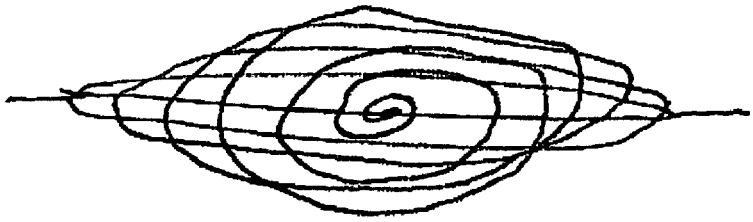
FIG. 9 is a dub head oscillating pattern of a golf club with misaligned shaft spine using the accepted static spine alignment test
Figure 10:
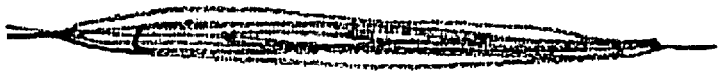
FIG. 10 is a club head oscillating pattern of a golf club with properly adjusted spine the accepted static spine alignment test

Shaft materials have a high strength to weight ratio to minimize the overall weight of the club while providing the necessary rigidity for desired performance. The development of graphite and other composites in shaft construction over the last 30 years has reduced driver shaft weight from over 100 grams for steel to around 50 grams for graphite, allowing a redistribution of weight favoring increased head weight for the same swing weight for the finished club. This evolution permits increased swing speeds or heavier heads or some combination of both for added distance. Adding back weight to the shaft must be approached carefully or the gain in shaft weight reduction will be nullified. As FIG. 7 shows, adding weight under the grip has the least effect on swing speed and can even increase it due to the optimizing effect of adjusting shaft flex, which is one of the objects of this invention. The best compromise of added weight versus flex adjustment for the shaft material used in this embodiment is a preferred length of assembly of 13 to 16 inches: lengths smaller than 12 inches have little range of flex adjustment (see FIG. 6) and longer lengths become too heavy and the benefit of added flex is contravened by the decreased speed contribution of excess weight (see FIG. 7). If lighter materials are used to manufacture the shaft insert, the range of insert lengths could be increased from 16 to perhaps 24 inches.

Common shaft manufacturing techniques for both steel and graphite require a thin wall construction with a circular cavity in the center of the golf club shaft 10. The existence of this cavity creates the opportunity for this invention, namely, the placement of a rigid shaft insert assembly within the cavity as shown in FIG. 2 and in detail in subsequent figures.

Refer now to the preferred embodiment of the invention shown in FIG. 3. The hollow rigid tubular shaft insert assembly coated with the cured compressible friction agent 18 is positioned inside the hollow cavity of the golf club shaft 10. A silicone adhesive, such as GE Silicone™, is a suitable material for the compressible friction agent To insure that the silicone adheres to the insert and not to the golf shaft itself, the silicone should cure while not in contact with the golf club shaft. It has the desirable properties of bonding to the shaft insert 16 after curing, and after insertion, holding the assembly in place by providing friction to the golf dub shaft 10, a large degree of compressibility enabling a wide range of insertion positions, and long life expectancy.

By adjusting the insertion depth P, of a shaft insert assembly that is 12 to 24 inches long, from about 1 to 10 inches will change the overall flex of the shaft of the golf club without altering its accepted cosmetic look. The assembly can be positioned most easily if the inside surface of the assembly is threaded so that an insert adjuster 17, which has the complimenting thread, can be joined to the assembly to easily decrease its penetration depth P. Once positioned, the shaft insert assembly is held by friction at the desired penetration depth P such that there is no reasonable likelihood of it working loose during a round of golf. The range of insertion possible, before the compressible friction agent will compress no more, is best accomplished if the shaft insert is tapered with a pitch roughly equal to the shaft into which it is to be placed. However, a cylindrical or non-tapered insert can be used for this purpose by using a thicker coating of compressible friction agent such that the overall shape of the shaft insert assembly is somewhat tapered.

A few shafts sold today are cylindrical under the grip having the taper begin some distance toward the shaft end attached to the head These shafts are more suitable to use with this invention, but the more common fully tapered shafts are found to have a suitable range of adjustment.

While a tubular shaft insert configuration is preferred due to its strength-to-weight ratio advantage, solid cross-section configurations can be employed and may enjoy a cost advantage.

The shaft insert assembly can be inserted before or after a grip has been installed on a shaft or club. The grip must have an opening at the butt end about 0.55 inches which is the approximate inner diameter of the shaft A special grip with an opening of this size can be installed or a standard grip modified to have a hole at the butt end of this size. This size hole will allow insertion of the shaft insert assembly as well as an insert adjuster 17, to make penetration adjustments or to completely remove the shaft insert assembly.

In general the extent of penetration P of the shaft insert assembly into the shaft will range from about 1 to about 10 inches. Adjustment of the extent of penetration P of the shaft insert assembly determines the overall flex of the shaft in the Toe and Swing Planes of the golf club and therefore the club's dynamic swing parameters. For instance, as the penetration of a 14-inch tubular graphite shaft insert assembly is varied over a seven inch range, the overall shaft flex, as measured in industry standard terms of frequency, changes approximately 7 cycles per minute (see FIG. 6). If a greater range is desired, an 18 inch assembly can be substituted providing a combined range of 12 cycles per minute, almost a complete flex as measured by industry standards. Alternatively, a stiffer shaft can be used as the starting point and the 14 inch assembly used with it to increase its flex by another 7 CPM. In this manner, a range of 30 CPM can be covered by three or four starting shafts and one 14 inch insert assembly. This CPM range covers 90 percent of the hundreds of golfers tested by the inventor using the traditional trial and error fitting methods to find the best flex for each player.

Other higher strength-to-weight ratio materials can be used to form the shaft inserts, e.g. graphite, aluminum, or titanium. These materials will increase the range of a single insert length and are within the scope of this invention. It should be obvious but for the sake of complete disclosure, an insert can only increase the overall stiffness of a golf shaft and cannot decrease the stiffness below the stiffness of the original golf shaft into which it is placed.

Figure 5:
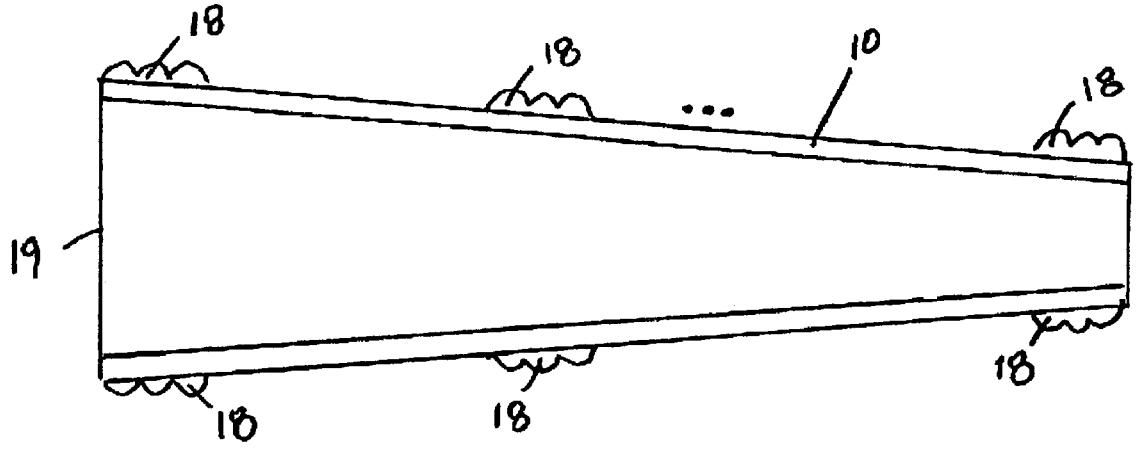
FIG. 5 is an expanded view of an alternative construction of the insert assembly

As the amount of penetration P of the shaft insert assembly is increased, the overall flex of the golf club shaft increases due to increased stiffness caused by the presence of the insert as it moves from a position under the grip farther into the middle portion of the golf club shaft 10 where bending of the shaft increases during a swing. When the golf club shaft 10 is not bent there is little effect from the presence of the shaft insert But during the swing of a club, the shaft typically bends a total of about three inches over its entire length, which affords the insert an opportunity to change the overall stiffness of the shaft Alternative Compressible Friction Agent Configuration An alternative embodiment of the invention, shown in FIG. 5, employs small pockets of said compressible friction agent 18 spaced over the length of the shaft insert 16 instead of covering the entire length of the insert as shown in FIG. 1. The holding power of each setting may be somewhat diminished compared to the previous alternative, but performance is comparable, and it is less costly to manufacture. In practice, as few as three pockets have been tested and found to be satisfactory.

Although the description above contains much specificity, these should not be construed as limiting the scope of the invention but as merely providing illustrations of some of the presently envisioned embodiments of this invention. Various other embodiments and ramifications that would occur to a workman in the field are possible within its scope. The scope of this invention is determined by the appended claims and their legal equivalents, rather than by the description and example given.

What is claimed is:

1. A method of adjusting the flex of a golf club having a dynamically swung golf club shaft comprising a first end attached to a grip section and a second end attached to a club head; wherein the method comprises:

(I) providing a hollow club head shaft having a tubular cross-section and having an elongated cavity extending from the grip section to the club head and an opening at a first end;

(II) providing a rigid shaft insert; wherein the rigid shaft insert has and outer surface, a female threaded inner surface, a length of 12 to 24 inches, and a weight of less than 50 grams;

(III) coating a compressible friction agent onto the outer surface of the rigid shaft insert wherein the compressible friction agent is a silicone adhesive;

(IV) curing the compressible friction agent on the outer surface of the rigid shaft insert;

(V) providing a male thread penetration adjuster;

(VI) placing the rigid shaft insert into the elongated cavity via the opening at the first end from about 1 inch to about 10 inches;

(VII) adjusting the placement of the rigid shaft insert by placing the male thread penetration adjuster into the inner surface of the rigid shaft insert to mate with the female threads; and (VIII) removing the male thread penetration adjuster after desired position is obtained.

2. The method of claim 1, wherein the step of curing a compressible friction agent comprises curing the compressible friction agent such that the coating is non-uniform.

* * * * *